United States Patent [19]

Okita

[11] Patent Number: 5,018,994

[45] Date of Patent: May 28, 1991

[54] TILTING/TRIMMING SYSTEM FOR MARINE PROPULSION UNIT

[75] Inventor: Ryozo Okita, Hamamatsu, Japan

[73] Assignee: Sanshin Kogyo Kabushiki Kaisha, Hamamatsu, Japan

[21] Appl. No.: 389,060

[22] Filed: Aug. 3, 1989

[51] Int. Cl.[5] ..... B63H 5/12

[52] U.S. Cl. ..... 440/61; 91/445

[58] Field of Search ..... 440/49, 53, 61, 418, 440/437, 444, 445, 448

[56] References Cited

U.S. PATENT DOCUMENTS

| | | | |
|---|---|---|---|
| 3,008,445 | 11/1961 | Frank | 440/61 |
| 3,722,455 | 3/1973 | Carpenter | 440/56 |
| 3,788,401 | 1/1974 | Scheidt | 172/801 |
| 3,842,789 | 10/1974 | Bergstedt | 440/61 |
| 3,999,502 | 12/1976 | Mayer | 440/61 |
| 4,909,766 | 3/1990 | Taguchi | 440/61 |

*Primary Examiner*—Galen Barefoot
*Assistant Examiner*—Clifford T. Bartz
*Attorney, Agent, or Firm*—Ernest A. Beutler

[57] ABSTRACT

A manually or magnetically operated selector valve for controlling the flow of hydraulic fluid through a hydraulic tilt and trim system of a marine outboard drive unit to achieve quick tilting up of the drive unit and slow trimming movement of the drive unit between a plurality of trim positions.

The hydraulic system includes at least one fluid motor interposed between the marine vessel and the drive unit for adjusting hte tilt and trim of the drive unit. A reversible fluid pump and reversible electric motor are used to power the fluid motor. In the slow trimming mode, the pump delivers fluid to only one fluid chamber of the fluid motor while the fluid in the other chamber is discharged back to the pump. In the quick tilt up mode, fluid is delivered to both fluid chambers of at least one fluid motor simultaneously.

17 Claims, 6 Drawing Sheets

TILTING/TRIMMING SYSTEM FOR MARINE PROPULSION UNIT

BACKGROUND OF THE INVENTION

The invention relates to a tilting and trimming system for an outboard drive unit of a marine vessel. More particularly, the invention relates to an improved hydraulically operated tilting and trimming system adapted for quick tilting-up of the drive unit and slow trimming of the drive unit.

As is well known, a variety of hydraulic systems have been employed for achieving tilt and trim movement of a marine outboard drive unit. These systems typically include a reciprocating hydraulic or fluid motor, which is interposed between the transom of the marine vessel and the drive unit for adjusting the tilt and the trim of the outboard drive unit in response to extension and contraction of the fluid motor. The fluid motor is powered by a fluid system that is normally contained within the hull of the marine vessel and may include a reversible electric motor and a reversible fluid pump. In connection with such systems, it is normal practice to include a pressure relief valve or valves in the hydraulic circuitry to the fluid motor so as to relieve pressure in the system and protect the system and drive unit from damage in the event the drive unit collides with a submerged or floating obstacle.

Previous tilt and trim systems have been arranged to provide for both quick tilting movement and slow trimming movement of a drive unit. However, such systems utilize a manual valve coupled to the gear control mechanism of the drive unit so that the valve is manually adjusted to achieve tilting and trimming by shifting the gears of the drive unit. An example of such a system is set forth in U.S. Pat. No. 3,842,789.

Unlike previous systems arranged to provide both quick tilting and slow trimming of an outboard drive unit, the present invention does not use a manual valve coupled to the drive unit gear control mechanism. In one embodiment of the present invention, a manually operated selector valve independent of the gear control is provided, adjustable between a first and a second position, to slowly trim the drive unit or quickly tilt-up the drive unit. In another embodiment of the invention, a magnetically operated selector valve is provided which is electrically linked to the gear control mechanism to effect slow trimming or quick tilting-up movement of the drive unit.

SUMMARY OF THE INVENTION

A first embodiment of this invention includes a manually operated selector valve embodied in a hydraulic tilt and trim system for an outboard drive unit mounted on the transom of a marine vessel for tilting movement and movement between a plurality of trim positions. The system includes a fluid motor extendably connecting the drive unit and transom or stationary part of the drive unit. The fluid motor has a cylinder housing and a moveable member, typically a piston rod and piston, which defines a pair of fluid chambers. In accordance with the invention, the system includes a pump for delivering hydraulic fluid from a reservoir to the fluid motor. The pump fluidly communicates with the fluid motor by way of first and second conduits. The first conduit communicates the pump with one of the fluid chambers and the second conduit communicates the pump with the other fluid chamber.

Another embodiment of the utilizes a magnetically operated selector valve to achieve quick tilt and slow trim movement of the outboard drive unit.

Both the manually and magnetically operated selector valves control the flow of hydraulic fluid from the pump to the fluid motor. When the valves are adjusted for slow trimming, the pump delivers hydraulic fluid to only one fluid chamber while the fluid in the other chamber is discharged to the pump in response to the movement of the moveable member. When the valves are adjusted for quick tilting-up of the drive unit, the pump delivers hydraulic fluid to both fluid chambers simultaneously.

DETAILED DESCRIPTION OF THE PREFERRED EMBODIMENTS

Figure 1:
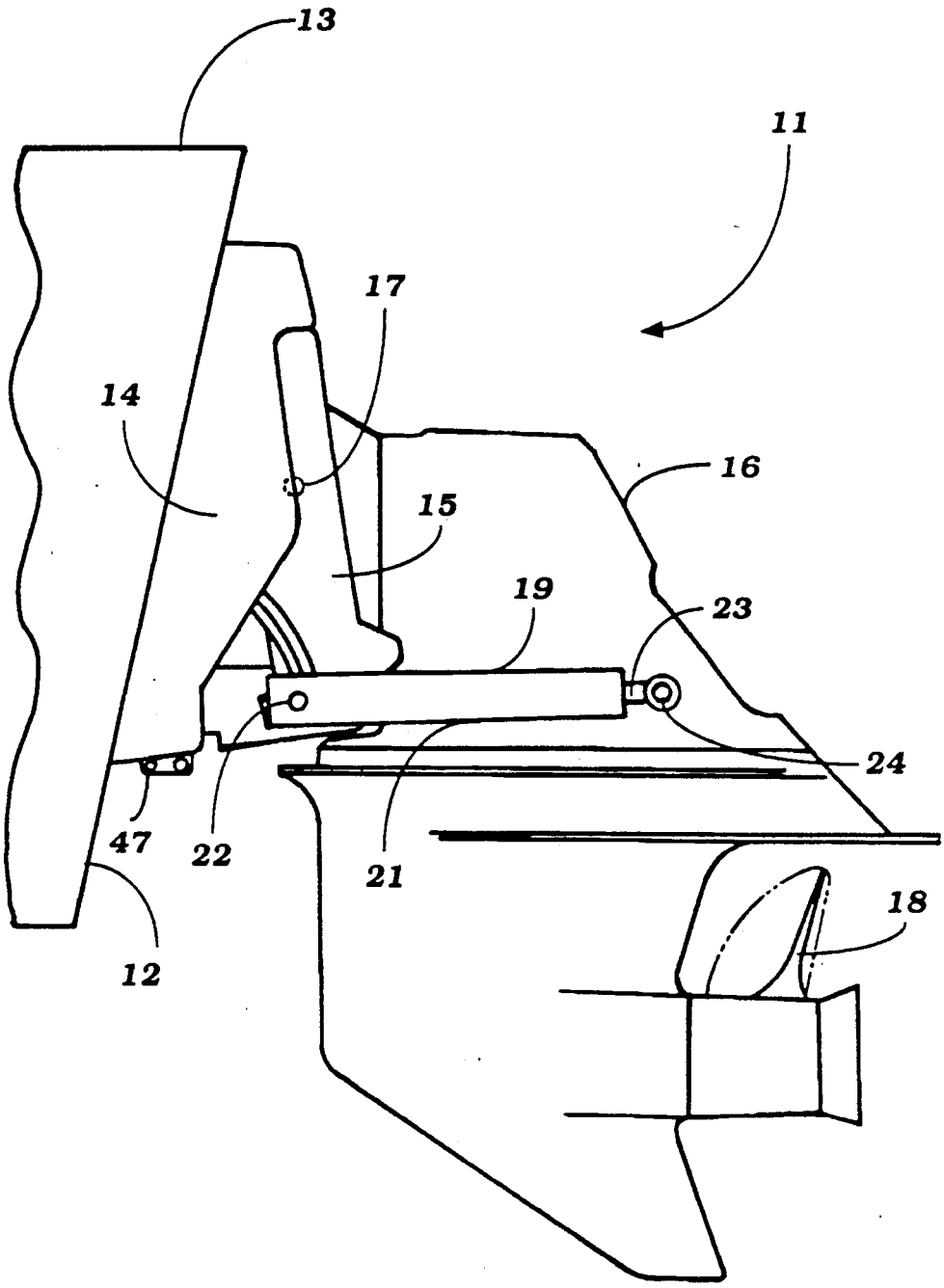
FIG. 1 is a partial side elevational view of a marine vessel having an outboard drive unit constructed in accordance with an embodiment of the invention.

Referring to FIG. 1, an outboard drive unit of an inboard/outboard drive assembly is indicated generally by the reference numeral 11 and is depicted as being attached to the transom 12 of the hull 13 of a marine vessel. The outboard drive unit 11 includes a gimbal housing 14 that is affixed to the transom 12 and which supports a gimbal ring 15 for steering movement about a vertically extending steering axis. An outboard drive housing 16 is pivotally connected to the gimbal ring 15 by means of pivot pins 17 for tilt and trim movement. A distributor housing 47 is mounted on the gimbal housing 14 of the outboard drive unit 11. The distributor housing 47 is illustrated in more detail in FIGS. 2 through 6.

An internal combustion engine (not shown) is mounted within the hull 13 and drives a propeller 18 of the outboard drive unit 11 through a conventional forward, neutral, reverse transmission (not shown). The construction of the outboard drive unit 11 per se is not necessary to understand the invention and, as will become apparent, the invention is adaptable for use with an outboard motor or the outboard stern-drive portion of an inboard/outboard engine system which are collectively called "outboard drive units" in the Specification and Claims.

The invention deals primarily with the hydraulic system for operating the tilt and trim of the outboard drive unit 11. This system comprises a pair of linear type fluid motors 19. Each fluid motor 19 includes a cylinder housing 21 that is journaled at one end on the gimbal ring 15 by means of a pivot pin 22. A piston rod 23 extends from the cylinder housing 21 and is pivotally connected to the adjacent side of the outboard drive housing 16 by a pivot pin 24.

Figure 2:
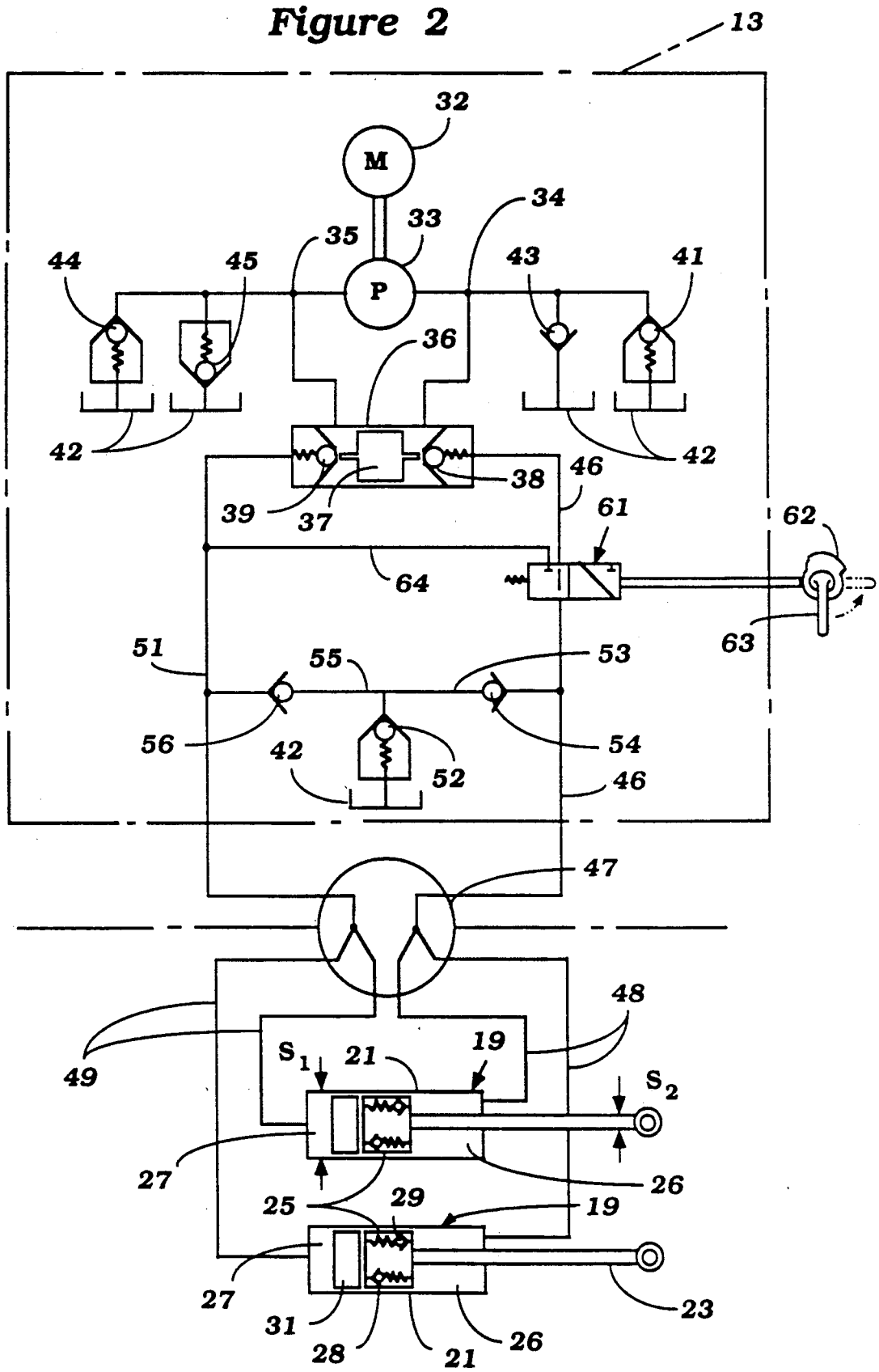
FIG. 2 is a schematic hydraulic circuit diagram of the low speed trimming mode, showing a first embodiment of the present invention.

The hydraulic circuitry for operating the system is illustrated in FIG. 2, wherein the internal details of the fluid motors 19 are depicted. Each fluid motor 19 includes a piston 25 that is connected to the piston rod 23 in a known manner. The pistons 25 divide the cylinder housings 21 into first and second fluid chambers 26 and 27. Pressure responsive absorber valves 28 permit flow from the chambers 26 to the chambers 27 in the event of impact with an underwater obstacle. Pressure responsive check valves 29 permit return flow once the obstacle has been cleared. Floating pistons 31 are contained within the chambers 27 and serve to retain the outboard drive housing 16 in a trim adjusted position.

Contained within the hull 13 of the marine vessel 11 is the system for selectively pressuring the chambers 26 or 27 or both to achieve power trim and tilt movement. This system includes a reversible electric motor 32 that drives a reversible fluid pump 33. The pump 33 has a pair of ports 34 and 35 that serve selectively as pressure or return ports depending on whether the outboard drive unit 11 is being trimmed up or trimmed down.

The ports 34 and 35 communicate with a shuttle valve assembly, indicated generally by the reference numeral 36. This assembly includes a shuttle piston 37 and a pair of check valves 38 and 39. The shuttle piston 37 has projections that are adapted to unseat the check valves 38 or 39 under an operation as will be described.

There is provided a pressure responsive relief valve 41 in communication with port 34 that permits flow back to a reservoir 42 in the event a high pressure condition exists in the pumping system. In a like manner a check valve 43 permits return flow to the system for make up purposes. A pressure relief valve 44 communicates the port 35 with the reservoir 42. A check valve 45 permits fluid to flow from the reservoir 42 to the port 35 for make up purposes.

FIG. 2 illustrates the hydraulic circuitry for operating the system in the low speed trimming mode. When the motor 32 and pump 33 are operated so as to deliver hydraulic fluid to and thereby pressurize port 34, the pressure in the shuttle valve assembly 36 will effect movement of the shuttle piston 37 to the left to open the check valve 39. The pressure in the shuttle valve assembly 36 also causes the check valve 38 to unseat and open communication with a first conduit 46 that extends, via a selector valve 61, to the distributor housing 47 that is mounted on the gimbal housing 14 of the outboard drive unit 11. The distributor housing 47 communicates the first conduit 46 with a pair of flexible conduits 48 that extend to the chambers 26 of the fluid motors 19. This will effect movement of the pistons 25 to the left so as to cause trim down operation.

During this operation, fluid is discharged from the chambers 27 through flexible hoses 49 to the distributor housing 47 for return to the shuttle valve 36 through a second conduit 51. The fluid returns through the open check valve 39 to the port 35 so as to provide return fluid for the system. A selector valve 61 having a manual selector 62 and a lever 63 prevents fluid flow from the second conduit 51 to the first conduit 46 through a bypass conduit 64 when the lever 63 is in a first position, as shown in FIG. 2.

For trim-up operation the motor 32 and pump 33 are driven in the opposite direction so as to pressurize the port 35 and cause the shuttle piston 37 to move to the right opening the check valve 38 so that the port 34 acts as a return port. The fluid pressure in the shuttle valve assembly 36 will open the check valve 39 and then flow through the second conduit 51 and flexible hoses 49 to pressurize the chambers 27 of fluid motors 19 and cause trim-up movement.

When the selector valve lever 63 is in the first position, the selector valve 61 prevents fluid flow from the second conduit 51 to the first conduit 46 through the bypass conduit 64.

The hydraulic system further includes a relief valve 52 and a manual bypass valve assembly positioned in the conduit system so as to relieve the hydraulic pressure in the event an impact is received on the drive housing that is greater than that which may be relieved through the pressure responsive valves 28 or 29. The valve 52 is positioned in the conduit system so that it can relieve impact loads in either direction. This bypass valve assembly includes a conduit 53 that extends from the first conduit 46 to the relief valve 52. The conduit 53 includes a check valve 54 that permits flow from the first conduit 46 to the conduit 53 and relief valve 52 but not flow in the opposite direction. A conduit 55 communicates the second conduit 51 with the valve 52. A check valve 56 is provided that permits flow from the second conduit 51 into the conduit 55 and relief valve 52 but not flow in the reverse direction. Thus, high pressure in the either of the chambers 26 or 27 of the fluid motors 19 can be relieved through the single relief valve 52.

Figure 3:
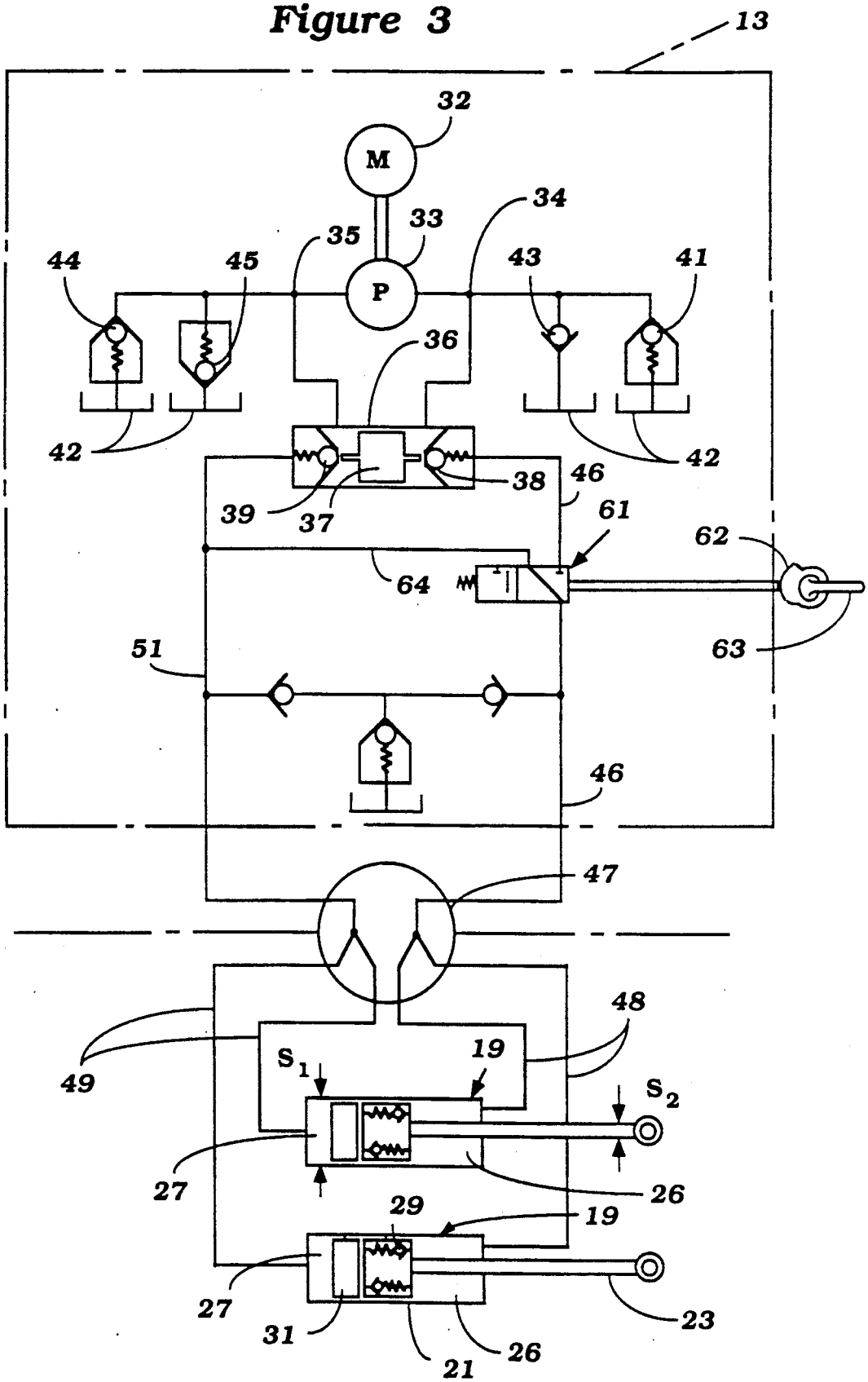
FIG. 3 is a schematic hydraulic circuit diagram showing the high speed tilting mode of the first embodiment.

FIG. 3 shows the hydraulic circuitry for operating the hydraulic system in the high speed tilt-up mode. In this arrangement, the motor 32 and pump 33 are operated so as to deliver hydraulic fluid to port 35 and pressurize port 35. The hydraulic fluid flows into the shuttle valve assembly 36 to effect movement of the shuttle piston 37 to the right causing check valve 38 to open. The pressure in the shuttle valve assembly 36 also causes check valve 39 to unseat and open communication with the second conduit 51. The operation described thus far is the same as the operation for low speed trim-up operation.

At this point the tilting up operation differs from the trimming up operation. In the tilting up operation, the selector valve 61 permits flow of hydraulic fluid from the second conduit 51 to the first conduit 46 through the bypass conduit 64 when the lever 63 is manually adjusted to a second position as shown in FIG. 3.

Thus, after entering the second conduit 51, approximately one half of the hydraulic fluid flows through the bypass conduit 64 and selector valve 61 to the first conduit 46 while approximately one half of the hydraulic fluid continues to flow through the second conduit 51. In this arrangement, the pump 33 delivers approximately equal fluid pressure to each of the first and second conduits 46 and 51. The distributor housing 47 communicates the first conduit 46 with flexible conduits 48 which extend to chambers 26 of the fluid motors 19 and communicates the second conduit 51 with flexible hoses 49 which extend to chambers 27. When the selector valve lever 63 is in the second position, the pump 33 delivers fluid pressure to both chambers 26 and 27 of the fluid motors 19 simultaneously. Since the pressure receiving cross-sectional area of chamber 27 given by $S_1$ is greater than the pressure receiving cross-sectional area of chamber 26 given by $S_1$-$S_2$ and since approximately equal pressure is delivered to each of the chambers 26 and 27, a quick outward movement of the piston rod 23, and thus a quick tilting-up of the drive unit 11 is achieved.

Figure 4:
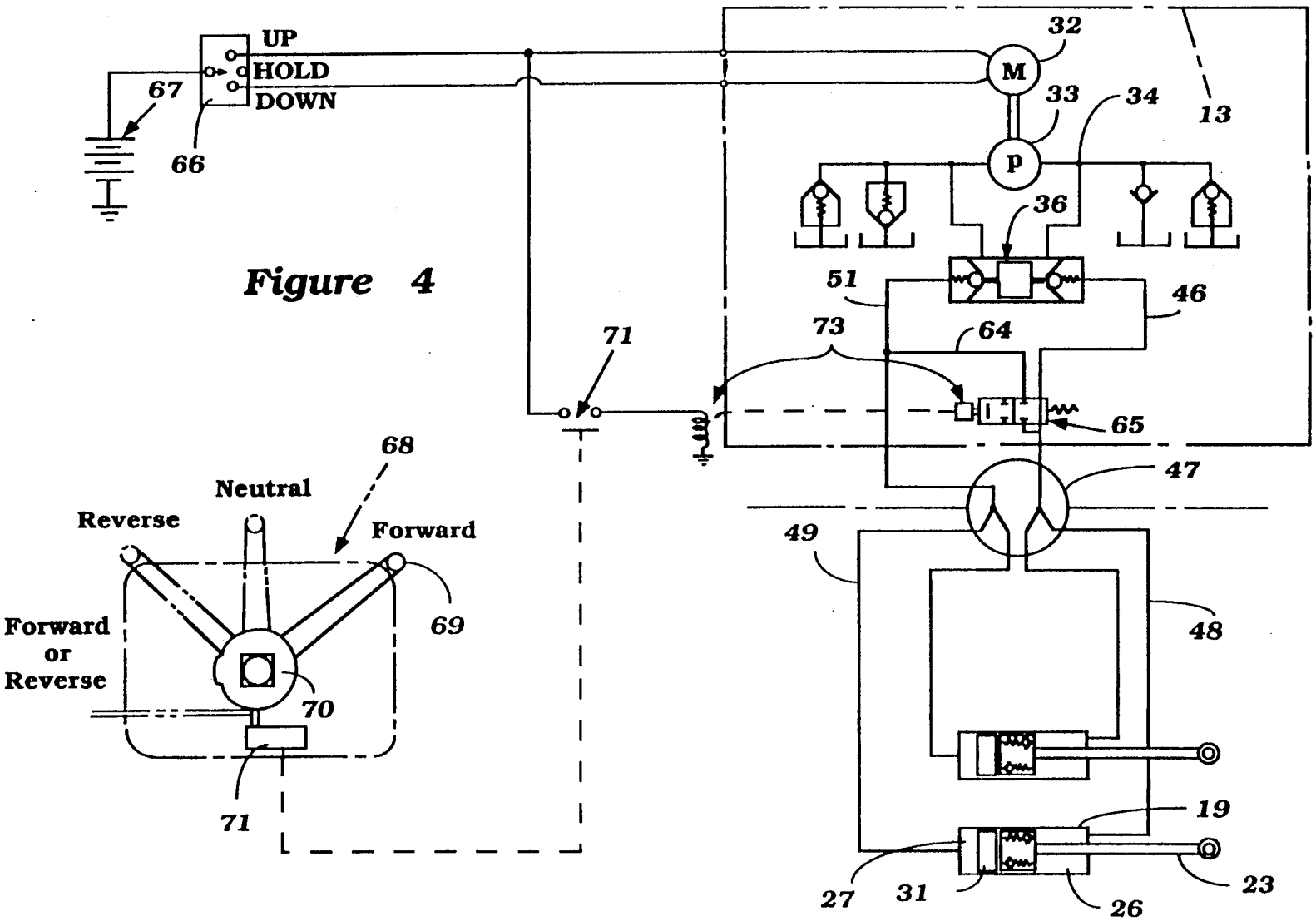
FIG. 4 is a schematic hydraulic circuit diagram of a second embodiment of the present invention showing the low speed trimming mode.

Referring to FIG. 4, a second embodiment of the hydraulic tilt and trim system is shown with magnetically operated selector valve 65. In this embodiment, the system further includes a switch 66 in circuit with a battery 67 and the motor 32 for operating the motor 32.

In this embodiment, the magnetically operated selector valve 65 includes a solenoid and a solenoid winding 73 shown displaced in FIG. 4. A gear-throttle control mechanism 68 is used to adjust the selector valve 65 between a first and second position for slow trimming and quick tilting of the drive unit 11. The control mechanism 68 includes an adjustable control lever 69 for operating the drive unit 11 in forward, reverse or neutral, and a casing member 70 secured to the control lever 69 at its pivot point. Movement of the control lever 69 between the forward, reverse and neutral positions effects movement of the magnetically operated selector valve 65 as hereinafter described. The control mechanism 68 is linked to the selector valve 65 through a switch 71 which has a pair of electrical contacts for opening and closing the circuit between the switch 66 and the selector valve 65. The position of the switch 71 is controlled by the position of the control lever 69.

When the control lever 69 is moved to a forward or reverse position, a knob on the casing member 70 releases the switch 71 so that the circuit between the switch 66 and selector valve 65 is open as shown in FIG. 4. When the control lever 69 is in forward or reverse, the selector valve 65 is in the first or trim adjusted position. The system is now arranged for slow trimming of the drive unit 11.

To trim up the drive unit 11, the switch 66 is adjusted to the "up" position so that current flows from the battery 67 to drive the motor 32 so as to pressurize port 35 (see FIG. 2). To trim down the drive unit 11, the switch 66 is adjusted to the "down" position to drive the motor 32 in the opposite direction to pressurize port 34 (see FIG. 2). The switch 66 also includes a "hold" position wherein the circuit between the battery 67 and the motor 32 is open so that no current flows to the motor 32. The "hold" position is used to maintain the drive unit 11 in its present trim adjusted position.

The magnetically operated selector valve 65 controls the flow of hydraulic fluid through the system as previously described with reference to the manually operated selector valve 61 in FIG. 2.

Quick tilting up of the drive unit 11 can be achieved when the control lever 69 of the gear-throttle control mechanism 68 is in the neutral position. When the control lever 69 is in that position, the casing member 70 depresses switch 71 so that its contacts close the circuit between the switch 66 and the selector valve 65. To achieve quick tilt up of the drive unit 11, the switch 66 is moved to the "up" position to drive the motor 32 so as to pressurize port 35 and to close the circuit between the battery 67 and the solenoid winding 73 of the selector valve 65. Current flows from the battery 67 through switches 66 and 71 to energize the solenoid causing the selector valve 65 to move to its second or tilt adjusted position.

The hydraulic fluid flows through the system as previously described with reference to FIG. 3. The pump 33 delivers fluid pressure to both chambers 26 and 27 simultaneously to effect quick tilt up of the drive unit 11.

Figure 5:
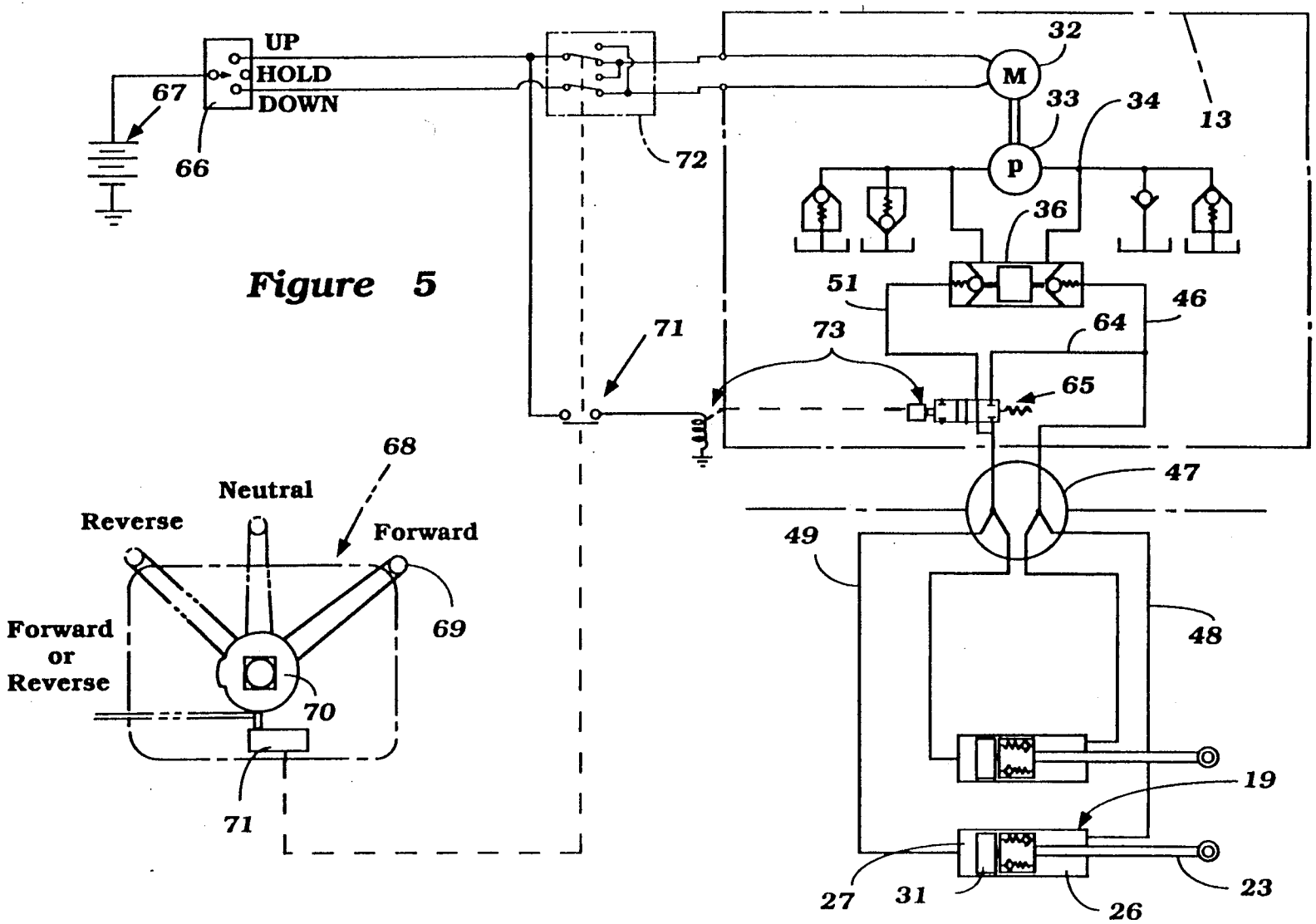
FIG. 5 is a schematic hydraulic circuit diagram of a third embodiment of the invention showing the low speed trimming mode.

In FIG. 5, the magnetically operated selector valve 65 controls the flow of fluid through the second conduit 51 and the bypass conduit 64 which is positioned between the first conduit 46 and the selector valve 65. The selector valve 65 is arranged so that when the valve 65 is in its first position, as shown in FIG. 5, it permits the flow of hydraulic fluid through the second conduit 51 and prevents the flow of fluid from the first conduit 46 to the second conduit 51 through the bypass conduit 64. When the selector valve 65 is in this position the system is arranged for slow trimming of the drive unit 11.

In this embodiment, the system further includes a switching device 72 in circuit with switch 66 and the motor 32 to further control the flow of current from the battery 67 to the motor 32. This switching device 72 includes two movable contacts. These contacts move together between a first position and a second position in response to the movement of switch 71.

When the control lever 69 is in a forward or reverse position, switch 71 is in its open position which causes the selector valve 65 to be in its first position and the movable contacts of the switching device 72 to also be in their first positions as shown in FIG. 5. This permits slow trimming up of the drive unit 11 when switch 66 is moved to its "up" position and slow trimming down of the drive unit 11 when the switch 66 is moved to its "down" position as previously described.

Quick tilting up of the drive unit 11 can be achieved when the control lever 69 is in the neutral position. When the lever 69 is in this position, the control mechanism 68 depresses switch 71 causing its contacts to close the circuit between switch 66 and the selector valve 65. The movement of switch 71 causes the moveable contacts of switching device 72 to move upward into their second positions. Switch 66 is then moved to the "up" position so that current from the battery 67 flows to the motor 32 so as to pressurize port 34. Current also flows from the battery 67 to energize the solenoid causing the selector valve 65 to move to its second or tilt adjusted position.

Figure 6:
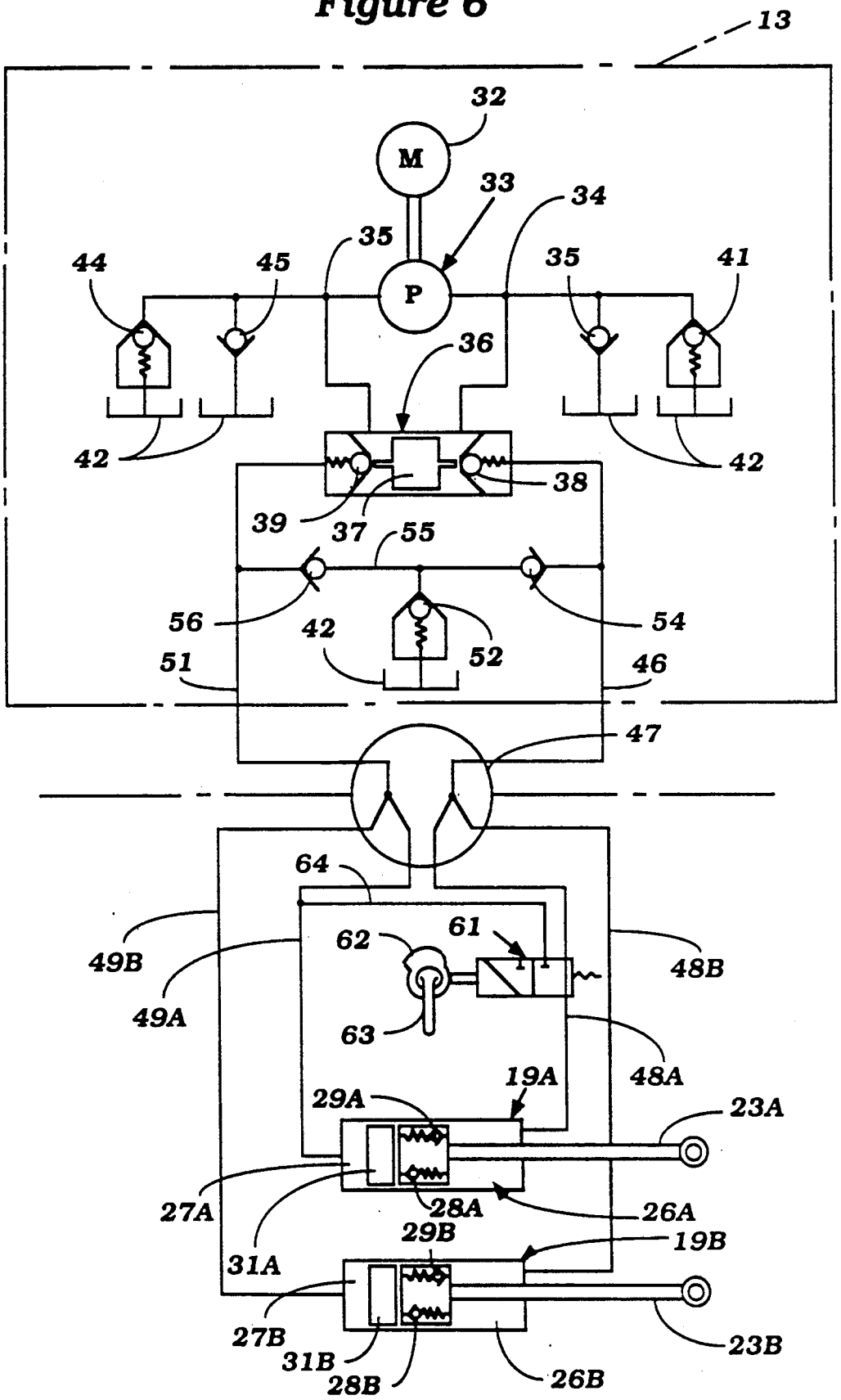
FIG. 6 is a schematic hydraulic circuit diagram of a fourth embodiment of the invention showing the low speed trimming mode.

FIG. 6 schematically illustrates the hydraulic circuitry of a fourth embodiment of the tilt and trim system with the manually operated selector valve 61 adjusted for low speed trimming of the outboard drive unit 11. In this embodiment, the selector valve 61 is positioned between the distributor housing 47 and first fluid motor 19A and is in circuit only with fluid motor 19A not second fluid motor 19B.

To trim down the drive unit 11, the motor 32 and pump 33 are operated to deliver hydraulic fluid to and thereby pressurize port 34. This fluid flow causes the shuttle piston 37 of the shuttle valve assembly 36 to move to the left to open the check valve 39. The pressure also causes the check valve 38 to unseat and open communication with the first conduit 46 that extends to the distributor housing 47. The distributor housing 47 communicates the first conduit 46 with a pair of flexible conduits 48A and 48B. Flexible conduit 48A extends to the first fluid chamber 26A of first fluid motor 19A through the manually operated selector valve 61 which controls the flow of hydraulic fluid through conduit 48A to first fluid chamber 26A. Flexible conduit 48B extends directly to the first fluid chamber 26B of the second fluid motor 19B. When the selector valve lever 63 is in the trim adjusted first position, as shown in FIG. 6, the selector valve 61 permits flow of hydraulic fluid through flexible conduit 48A so that chambers 26A and 26B are pressurized. This will effect movement of pistons 25A and 25B and piston rods 23A and 23B of fluid motors 19A and 19B to the left so as to cause trim down operation.

The fluid is then discharged from the second fluid chambers 27A and 27B of the first and second fluid motors 19A and 19B through flexible hoses 49A and 49B respectively to the distributor housing 47 and ultimately to port 35 as previously described. This provides return fluid for the system.

Pressure responsive absorber valves 28A and 28B, pressure responsive check valves 29A and 29B and floating pistons 31A and 31B previously designated by numerals 28, 29 and 31 respectively have previously been described with reference to FIG. 2.

To trim up the drive unit 11, the motor 32 and pump 33 are driven in the reverse direction. Port 35 is pressurized causing the shuttle piston 37 to move to the right opening check valve 38 so that port 34 acts as a return port. The fluid pressure will open check valve 39 and then flow through second conduit 51 and flexible hoses 49A and 49B to pressurize chambers 27A and 27B and cause trim up movement.

If lever 63 is moved to its second or tilt adjusted position, the hydraulic system illustrated in FIG. 6 is in its tilt-up mode. In this arrangement, the motor 32 and pump 33 deliver hydraulic fluid to port 35 to pressurize that port. The fluid flows through the shuttle valve assembly 36 into second conduit 51. The distributor housing 47 communicates the second conduit 51 with flexible hoses 49A and 49B. When the selector valve 61 is in its tilt adjusted position, the valve 61 permits fluid flow from flexible hose 49A through the bypass conduit 64 and valve 61 into flexible conduit 48A so that the pump 33 delivers fluid pressure to both chambers 26A and 27A of the first fluid motor 19A simultaneously. This causes a quick outward movement of piston rod 23A and therefore a quick tilting-up of the drive unit 11. The chambers 26B and 27B of the second fluid motor 19B are not pressurized simultaneously in this embodiment since the selector valve 61 is not connected with the second fluid motor 19B. Instead, fluid is delivered to the second fluid chamber 27B of the second fluid motor 19B. Fluid is discharged form the first chamber 26B through flexible conduit 48B back to the pump 33 in response to the outward movement of the piston rod 23B of fluid motor 19B which is driven by the movement of first fluid motor 19A. The relief valve 52 and manual bypass valve assembly shown in FIG. 6 operates here in the same manner as described in FIG. 2.

Although several embodiments of the invention have been described, various changes or modifications may be made in the embodiments without departing from the spirit and scope of the invention as defined by the appended claims.

I claim:

1. A hydraulic tilt and trim system for an outboard drive unit mounted on the transom of a marine vessel for tilting movement of the drive unit and movement between a plurality of trim positions, comprising at least one fluid motor extendably connecting the drive unit and transom or stationary part of the drive unit, said fluid motor having a cylinder housing and a moveable member defining a pair of fluid chambers, a pump for delivering hydraulic fluid to said fluid motor, a first conduit fluidly communicating said pump with one of said chambers, a second conduit fluidly communicating said pump with the other of said chambers, a manually operated selector valve adapted to be adjustably positioned for effecting quick tilting-up movement of the drive unit or slow trimming movement of the drive unit between a plurality of trim positions, and a bypass valve assembly positioned between and in communication with said first and second conduits so as to relieve hydraulic pressure in the system in the event an impact is received on the drive unit regardless of the position of said selector valve.

2. A hydraulic tilt and trim system as recited in claim 1, further comprising a bypass conduit fluidly communicating with said selector valve.

3. A hydraulic unit and trim system as recited in claim 2, wherein said selector valve controls the flow of hydraulic fluid between said pump and one of said fluid chambers through at least two of said conduits.

4. A hydraulic tilt and trim system as recited in claim 3, wherein said selector valve comprises a manual selector and a lever adjustable between a first position and a second position.

5. A hydraulic tilt and trim system as recited in claim 4, wherein, when said lever is in said first position, said pump delivers hydraulic fluid to only one of said chambers, the fluid in the other chamber being discharged to said pump in response to the movement of said moveable member to slowly trim the drive unit between a plurality of trim positions.

6. A hydraulic tilt and trim system as recited in claim 5, wherein, when said lever is in said second position, said pump delivers hydraulic fluid to both of said chambers simultaneously to quickly tilt-up the drive unit.

7. A hydraulic tilt and trim system for an outboard drive unit mounted on the transom of a marine vessel for tilting movement of the drive unit and movement between a plurality of trim positions, comprising at least one fluid motor extendably connecting the drive unit and transom or stationary part of the drive unit, said fluid motor having a cylinder housing and a moveable member defining a pair of fluid chambers, a pump for delivering hydraulic fluid to said fluid motor, said hydraulic tilt and trim system further comprising a gear control mechanism, a switch and a magnetically operated selector valve electrically linked to and adapted to be adjustably positioned by said gear control mechanism and said switch for effecting quick tilting-up movement of the drive unit or slow trimming movement of the drive unit between a plurality of trim positions.

8. A hydraulic tilt and trim system as recited in claim 7, further comprising a first conduit fluidly communicating said pump with one of said chambers, a second conduit fluidly communicating said pump with the other of said chambers, and a bypass conduit fluidly communicating with said selector valve.

9. A hydraulic tilt and trim system as recited in claim 8, wherein said selector valve controls the flow of hydraulic fluid between said pump and one of said fluid chambers through at least two of said conduits.

10. A hydraulic tilt and trim system as recited in claim 9, wherein said selector valve is adjustable between a first position and a second position.

11. A hydraulic tilt and trim system as recited in claim 10, wherein, when said selector valve is in said first position, said pump delivers hydraulic fluid to only one of said chambers, the fluid in the other chamber being discharged to said pump in response to the movement of said moveable member to slowly trim the drive unit between a plurality of trim positions.

12. A hydraulic tilt and trim system as recited in claim 11, wherein, when said selector valve is in said second position, said pump delivers hydraulic fluid to both of said chambers simultaneously to quickly tilt-up the drive unit.

13. A hydraulic tilt and trim system for an outboard drive unit mounted on the transom of a marine vessel for tilting movement of the drive unit and movement between a plurality of trim positions, comprising first and second fluid motors extendably connecting the drive unit and transom or stationary part of the drive unit, said fluid motors having cylinder housings and moveable members defining first and second fluid chambers in each fluid motor, a pump for delivering hydraulic fluid to said fluid motors, a first conduit fluidly communicating said pump with said first fluid chambers in each of said fluid motors, a second conduit fluidly communicating said pump with said second fluid chambers in each of said fluid motors, a manually operated selector valve adapted to be adjustably positioned for effecting quick tilting-up movement of the drive unit or slow trimming movement of the drive unit between a plurality of trim positions, and a bypass valve assembly positioned between and in communication with said first and second conduits so as to relieve hydraulic pressure in the system in the event an impact is received on the drive unit regardless of the positions of said selector valve.

14. A hydraulic tilt and trim system as recited in claim 13, wherein said selector valve controls the flow of hydraulic fluid between said pump and said first fluid chamber of said first fluid motor but does not control the flow of hydraulic fluid between said pump and said second fluid motor.

15. A hydraulic tilt and trim system as recited in claim 14, wherein said selector valve comprises a manual selector and a lever adjustable between a first and second position.

16. A hydraulic tilt and trim system as recited in claim 15, wherein, when said lever is in said first position, said pump delivers hydraulic fluid to one of said fluid chambers in each of said fluid motors only, the fluid in the other of said fluid chambers being discharged to said pump in response to the movement of said moveable members to slowly trim the drive unit between a plurality of trim positions.

17. A hydraulic tilt and trim system as recited in claim 16, wherein, when said lever is in said second position, said pump delivers hydraulic fluid to said first and second fluid chambers of said first fluid motor simultaneously and delivers hydraulic fluid to said second chamber of said second fluid motor only to quickly tilt-up the drive unit.

* * * * *